US011819149B1

(12) United States Patent
Etchison et al.

(10) Patent No.: US 11,819,149 B1
(45) Date of Patent: Nov. 21, 2023

(54) BEVERAGE INSULATOR WITH ADAPTABLE BEVERAGE LIFT FLOOR

(71) Applicant: BeerWhere LLC, Chapel Hill, NC (US)

(72) Inventors: David Wesley Etchison, Chapel Hill, NC (US); Solomon Tibebu, Alexandria, VA (US)

(73) Assignee: BEERWHERE LLC, Chapel Hill, NC (US)

( * ) Notice: Subject to any disclaimer, the term of this patent is extended or adjusted under 35 U.S.C. 154(b) by 0 days.

(21) Appl. No.: 17/851,847

(22) Filed: Jun. 28, 2022

Related U.S. Application Data

(60) Provisional application No. 63/217,204, filed on Jun. 30, 2021.

(51) Int. Cl.

| | |
|---|---|
| ***A47G 19/22*** | (2006.01) |
| ***B65D 81/38*** | (2006.01) |
| ***B65D 25/28*** | (2006.01) |
| ***B65D 25/10*** | (2006.01) |
| ***B65D 43/02*** | (2006.01) |

(52) U.S. Cl.
CPC ..... *A47G 19/2288* (2013.01); *B65D 25/10* (2013.01); *B65D 25/28* (2013.01); *B65D 43/0229* (2013.01); *B65D 81/3881* (2013.01)

(58) Field of Classification Search
CPC ..... B65D 81/3876; B65D 81/3881; B65D 81/3883; B65D 81/3886; B65D 43/0225; B65D 43/0229; B65D 47/00; B65D 47/04; B65D 47/06; B65D 25/10; B65D 25/28; A47G 23/02; A47G 23/0266
See application file for complete search history.

(56) References Cited

U.S. PATENT DOCUMENTS

| | | | | |
|---|---|---|---|---|
| 5,212,963 | A * | 5/1993 | McGinnis | F25D 31/007 62/530 |
| 10,457,471 | B2 * | 10/2019 | Jacob | B65D 43/0229 |
| 11,375,835 | B2 * | 7/2022 | Sherburne | A47J 41/022 |
| 2008/0098853 | A1 | 5/2008 | Choate | |
| 2016/0150901 | A1 | 1/2016 | Dokhanian | |
| 2018/0333007 | A1 | 11/2018 | Ganahi | |

(Continued)

OTHER PUBLICATIONS

Stainless Steel Insulated Tumbler 20 oz—Triple Wall with Beer Opener—Travel Cup Cocktail Coffee Rambler—20 oz Tumbler Opener Silicone BOOT—100% Leak Proof Screw Lid—Gangster Cup (Black 20oz) not later than Jun. 10, 2021, located at https://smile.amazon.com/dp/B09VB5TH6H/ref=cm_sw_em_r_mt_dp_MG3TE3XZT8ZEQVMM5F39?th=1, 10 pages as printed, Amazon.com, Inc. Seattle Washington, United States of America.

(Continued)

*Primary Examiner* — Javier A Pagan
(74) *Attorney, Agent, or Firm* — FLYNN IP LAW; Kevin E Flynn

(57) ABSTRACT

A beverage insulator with an adjustable beverage lift assembly that allows a user to set a height for positioning a beverage container inserted within the open end of the beverage insulator so that the beverage container protrudes a sufficient amount for drinking from the top of the beverage container but keeps much of the beverage container surrounded by the beverage lift assembly. The user can adjust the beverage lift assembly to work with cans and bottles of different sizes.

20 Claims, 13 Drawing Sheets

(56) References Cited

U.S. PATENT DOCUMENTS

| | | | | |
|---|---|---|---|---|
| 2020/0002054 | A1* | 1/2020 | Gronkowski | B65D 81/3205 |
| 2021/0068567 | A1* | 3/2021 | Ganter, I | A47G 19/2227 |
| 2021/0127890 | A1* | 5/2021 | Baston | A47J 31/0626 |

OTHER PUBLICATIONS

Universal Buddy 2.0 | Cotton Candy Glitter, not later than Jun. 20, 2021, located at https://frostbuddy.com/products/universal-buddy-2-0-cotton-candy-glitter 11 pages of gathered screen shots of the various images from this page, FrostBuddy, Newtown IL, United States of America.

CanKeeper 3-In-1—FITS 12oz, 16oz and Slim Cans—Keep Your Can Cold For Hours—Double Walled and Vacuum Insulated Can Cooler—Lid Keeps Cold In, Dirt Out (Neo Chrome), not later than Jun. 20, 2021, 10 pages with the screen shots of the various image, Amazon.com, Inc. Seattle Washington, United States of America.

* cited by examiner

110

110

210

250

200

210

250

290

200

300

300

300

190

400

400

350

350

BEVERAGE INSULATOR WITH ADAPTABLE BEVERAGE LIFT FLOOR

This application claims the benefit of commonly assigned U.S. Provisional Patent Application No. 63/217,204 for Beverage Insulator with Adaptable Beverage Lift Floor filed Jun. 30, 2022. The '204 application is incorporated by reference in its entirety.

BACKGROUND

Field of the Disclosure

This disclosure relates generally to insulated containers that may be used to hold a can or bottle containing a beverage such as beer, other alcoholic beverages such as hard cider, hard seltzer, wine, wine coolers, or pre-mixed cocktails, or non-alcoholic drinks such as soda, lemonade, or iced tea.

Dual walled containers with a vacuum between the walls are known and have been used both for thermoses and insulated tumblers of various shapes. These dual walled containers help insulate an item, typically a fluid, from moving towards the ambient temperature of the surroundings. These tumblers come in a range of sizes. Some tumblers are solely intended to serve as an insulated cup and fluid is poured directly into the interior of the tumbler and the fluid is slowed from reaching the ambient temperature by the insulative properties of the tumbler walls and possibly the tumbler bottom. The ability to create an insulated tumbler whether by use of a dual walled vacuum insulation or other form of insulation is well-known and will not be explained within this disclosure.

In many instances, a tumbler is sized to receive a bottle or can to slow the change of the contents of the bottle or can to the ambient temperature. Frequently the bottle or can is chilled and the insulated tumbler slows the warming of the beverage within the bottle or can.

A problem in the art is that beverage cans come in a number of standard sizes. In the United States, the most common can size is a twelve-ounce fluid volume can that is 4.83 inches tall with a maximum width of 2.6 inches. There are many other can sizes common in the United States including cans that are sixteen ounces. There are also slim cans that are taller and narrower in the twelve-ounce size. Beyond that there are hybrid aluminum cans that have a shape that partially emulates a bottle.

Beverages also come in bottles of various shapes. Many of the bottles hold twelve ounces or sixteen ounces, but some hold other volumes such as 500 milliliters.

Many people like to taste beverages, such as beer, that were imported from a country that uses other standard sizes for beer cans or beer bottles. Thus adding beverage containers from other countries further expands the variety of beverage containers intended for individual consumption. An end user would like to have a beverage insulator that works with a set of at least two different beverage containers where the height from the opening at the top of the first container to the bottom of the first container is different from the height from the opening at the top of the second container to the bottom of the second container. Merely having the taller container protrude more above the top end of the beverage insulator would be a suboptimal solution as having additional surface area of the taller container exposed to ambient temperature would hasten the warming of the beverage within the beverage container.

One could have an insert that sits inside an insulated container like a booster seat to lift a smaller beverage container up. So an insulated container designed for a sixteen-ounce container could have a kit with an insert to allow a twelve-ounce container to sit on the booster seat to lift the smaller container up to an acceptable height. This is sub-optimal for several reasons. First it requires an end user to keep up with the booster seat. If the end user is at an event with beverages of different sizes, the end user would need to carry the booster seat around while using the insulated container with a larger beverage container. Furthermore this booster seat does not address handling the broad array of beverage containers unless there are several booster seats for several different sizes of beverage containers. At some point, handling an array of booster seats for the various sizes of beverage containers becomes untenable for people who are on the go. A foreseeable failure mode is that one or more booster seats will be set down and left at an event.

Images of some of the many sizes and shapes of beverage containers are set forth in APPENDIX A that accompanies this application.

Vocabulary

A, An.

In this application, and the claims that follow, the terms a, an, or the identification of a single thing should be read as at least one unless such an interpretation is impossible within the context of the entirety of the specification. For example, the use of the terms sole, only, or the phrase not more than one would indicate that a single item is intended.

Gne and Gnes.

To avoid the awkward he/she and his/her or the potentially confusing singular use of they and their, this application uses the gender-neutral pronoun gne and the possessive gnes.

Or.

Unless explicit to the contrary, the word "or" should be interpreted as an inclusive or rather than an exclusive or. Thus, the default meaning of or should be the same as the more awkward and/or.

Proximal and Distal.

Proximal and distal should be considered relative to the user. Thus the proximal end of the component is the portion of the component that is towards the open end of the insulated tumbler. The distal portion of a component would be the end of the component towards the end of the device that is inserted into the insulated tumbler.

Set.

Unless explicit to the contrary, the word "set" should be interpreted as a group of one or more items.

Step.

The term step may be used in descriptions within this disclosure. For purposes of clarity, one distinct act or step may be discussed before beginning the discussion of another distinct act or step. The term step should not be interpreted as implying any particular order among or between various steps disclosed unless the specific order of individual steps is expressly indicated.

Substantially.

Frequently, when describing an industrial process it is useful to note that a given parameter is substantially met. Examples may be substantially parallel, substantially perpendicular, substantially uniform, and substantially flat. In this context, substantially X means that for purposes of this industrial process it is X. So something that may not be absolutely parallel but is for all practical purposes parallel, is substantially parallel. Likewise, mixed air that has substantially uniform temperature would have temperature deviations that were inconsequential for that industrial process.

As recognized in C. E. Equipment Co. v. United States, 13 U.S.P.Q.2d 1363, 1368 (Cl. Ct. 1989), the word "substantially" in patent claims gives rise to some definitional leeway—thus the word "substantially" may prevent avoidance of infringement by minor changes that do not affect the results sought to be accomplished.

SUMMARY OF THE DISCLOSURE

Aspects of the teachings contained within this disclosure are addressed in the claims submitted with this application upon filing. Rather than adding redundant restatements of the contents of the claims, these claims should be considered incorporated by reference into this summary.

This summary is meant to provide an introduction to the concepts that are disclosed within the specification without being an exhaustive list of the many teachings and variations upon those teachings that are provided in the extended discussion within this disclosure. Thus, the contents of this summary should not be used to limit the scope of the claims that follow.

Inventive concepts are illustrated in a series of examples, some examples showing more than one inventive concept. Individual inventive concepts can be implemented without implementing all details provided in a particular example. It is not necessary to provide examples of every possible combination of the inventive concepts provided below as one of skill in the art will recognize that inventive concepts illustrated in various examples can be combined together in order to address a specific application.

Other systems, methods, features and advantages of the disclosed teachings will be immediately apparent or will become apparent to one with skill in the art upon examination of the following figures and detailed description. It is intended that all such additional systems, methods, features and advantages be included within the scope of and be protected by the accompanying claims.

BRIEF DESCRIPTION OF THE FIGURES

The disclosure can be better understood with reference to the following figures. The components in the figures are not necessarily to scale, emphasis instead being placed upon illustrating the principles of the disclosure. Moreover, in the figures, like reference numerals designate corresponding parts throughout the different views.

DETAILED DESCRIPTION

The presently disclosed subject matter is described with specificity to meet statutory requirements. However, the description itself is not intended to limit the scope of this patent. Rather, the inventors have contemplated that the claimed subject matter might also be embodied in other ways, to include different steps or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described.

Before showing the complete assembly of the beverage insulator 100, it is useful to introduce the assembly components.

Insulated Shell.

Figure 1:
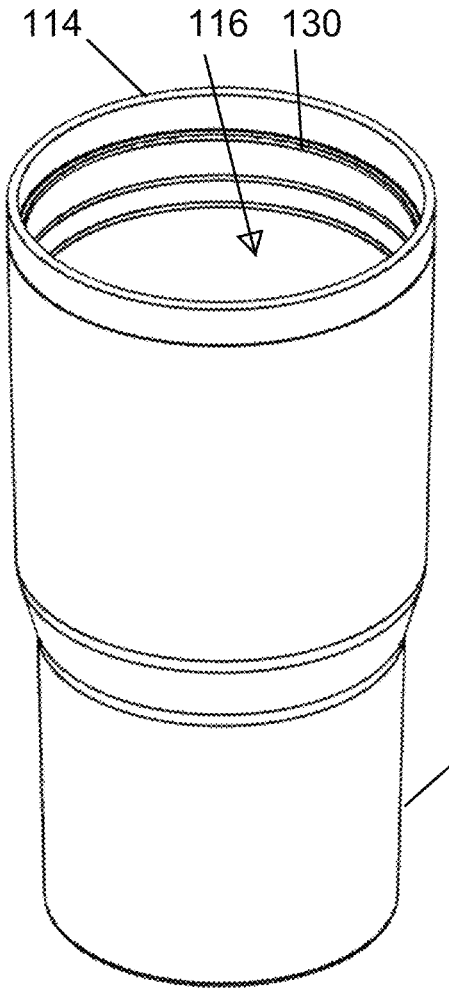
FIG. 1 shows a top perspective view of insulated shell 110.
Figure 2:
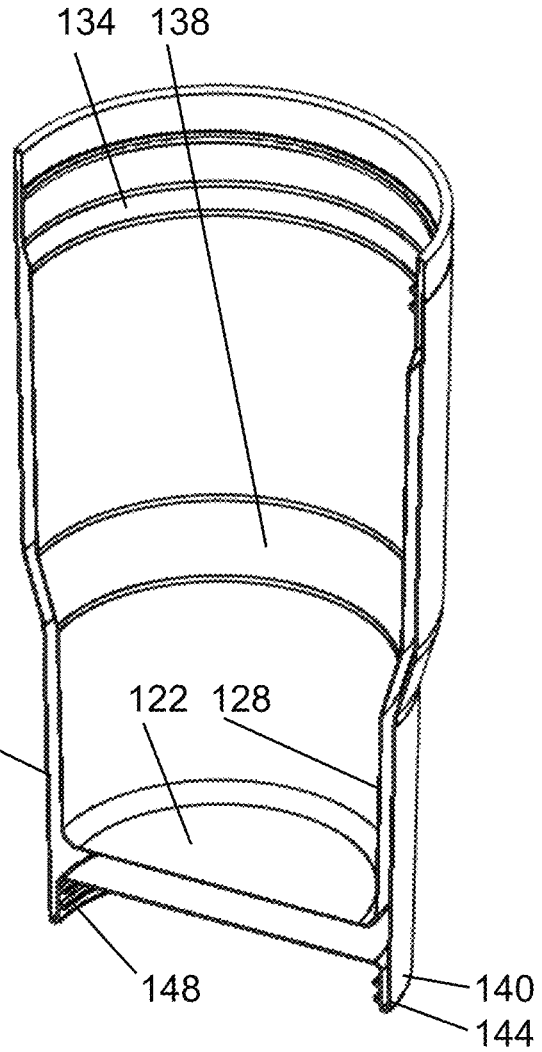
FIG. 2 provides a cross section of that same view.

FIG. 1 shows a top perspective view of insulated shell 110. FIG. 2 provides a cross section of that same view. In many instances, the insulated shell is an insulated tumbler so that an end user may use the insulated tumbler to hold a fluid and allow the end user to drink the fluid without the use of a beverage container. While the term tumbler often conveys that there are not handles as one would find on a coffee mug or a beer stein, for purposes of this disclosure and the claims that follow, the term tumbler embraces tumblers with or without one or more handles.

Those of skill in the art will appreciate that a beverage insulator 100 in accordance with the teachings of the present application may have an insulated shell 110 that is not suitable for using as a drinking tumbler. So an end user cannot simply pour a liquid into the insulated shell 110 and drink the liquid but must only use the beverage insulator 100 to receive, hold, and insulate a beverage container. The insulated shell 110 may be inappropriate for use as a drinking container as the insulated shell 110 may have one or more drains to drain off condensation. The insulated shell 110 may be inappropriate for use as a drinking container as the insulated shell 110 may be made from materials that are not suitable for use as a drinking container as the materials used for the interior of the insulated shell 110 may not be approved for this use.

Insulated shell 110 has an open top end 114, an interior volume 116, a closed bottom end 122, and interior thread 130. The insulated shell 110 also has dual walls 124 and 128 to enhance the insulation properties of the insulated shell 110. The interior of the insulated tumbler 100 has an upper bevel 134 and a lower bevel 138. This particular insulated tumbler 100 has an interior volume of thirty ounces but insulated tumblers may be made in other sizes and aspect ratios.

An optional lower portion 140 with cylindrical wall 144 and internal thread 148 may be provided to engage an optional bottle opener 400 discussed below.

Beverage Lift Assembly.

Figure 3:
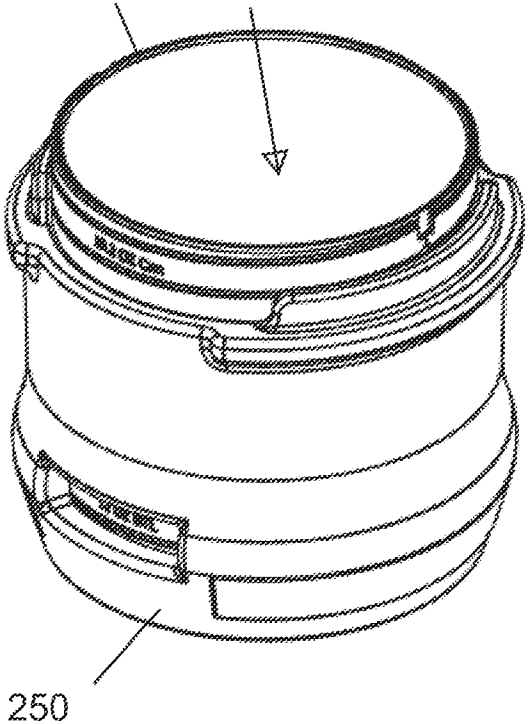
FIG. 3 is a top perspective view of beverage lift assembly 200 which has a beverage carriage 210 and a beverage lift sleeve 250. The beverage carriage 210 has an open top end 214.

FIG. 3 is a top perspective view of beverage lift assembly 200 which has a beverage carriage 210 and a beverage lift sleeve 250. The beverage carriage 210 has an open top end 214.

Figure 4:
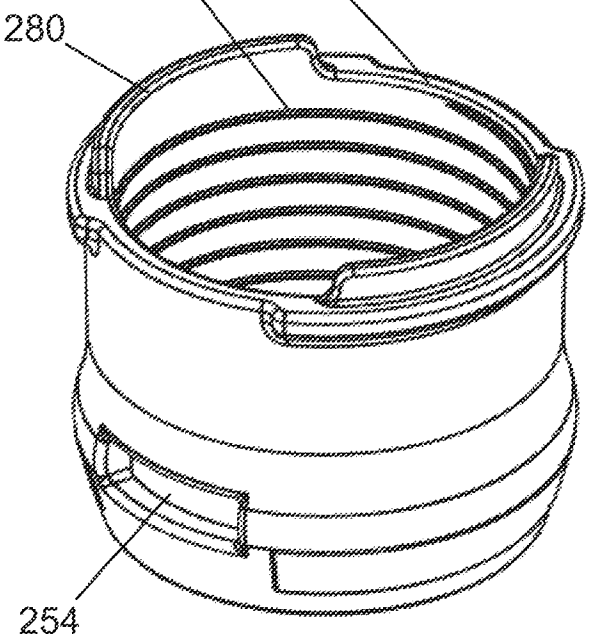
FIG. 4 is a top perspective view of beverage lift sleeve 250.

FIG. 4 is a top perspective view of beverage lift sleeve 250.

Figure 5:
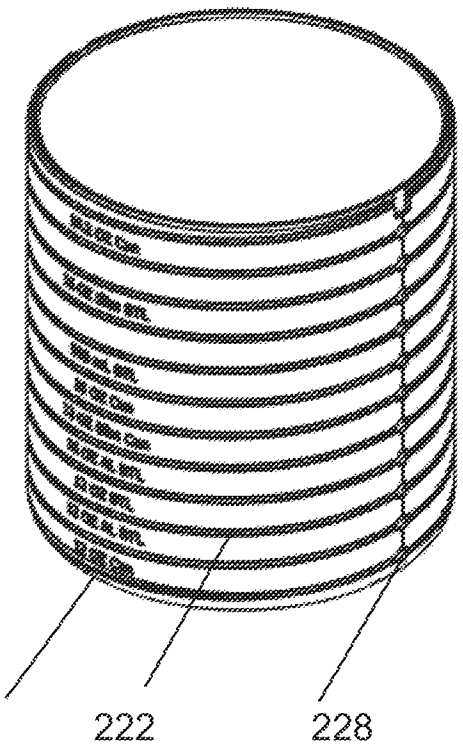
FIG. 5 is a top perspective view of beverage carriage 210.

FIG. 5 is a top perspective view of beverage carriage 210.

Figure 6:
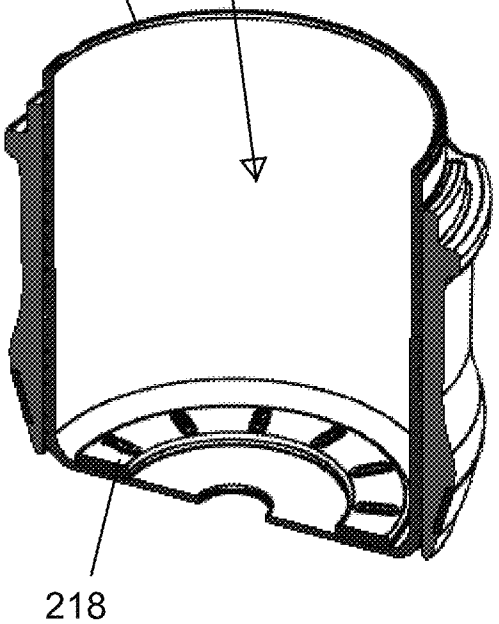
FIG. 6 is a cross section of FIG. 3 showing beverage lift assembly 200 with beverage carriage 210 and beverage lift sleeve 250.

FIG. 6 is a cross section of FIG. 3 showing beverage lift assembly 200 with beverage carriage 210 and beverage lift sleeve 250.

Figure 7:
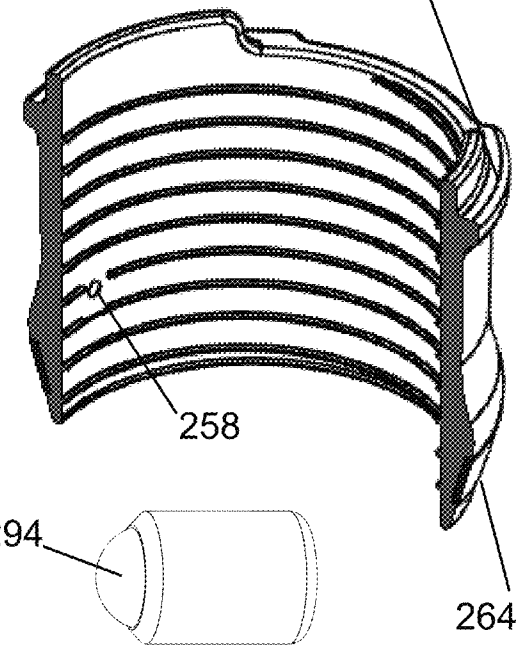
FIG. 7 is a cross section of the top perspective view of beverage lift sleeve 250 from FIG. 4.

FIG. 7 is a cross section of the top perspective view of beverage lift sleeve 250 from FIG. 4.

Figure 8:
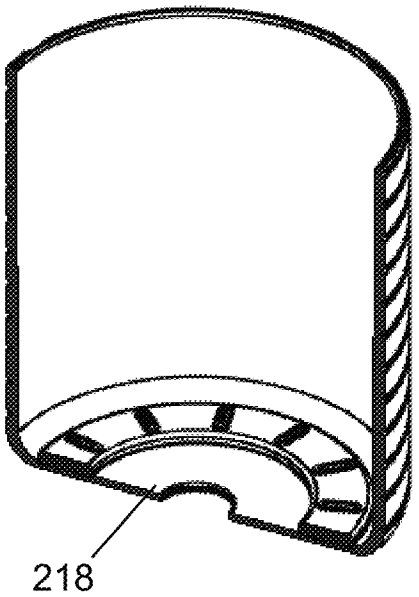
FIG. 8 is a cross section of FIG. 5 showing the top perspective view of beverage carriage 210.

FIG. 8 is a cross section of FIG. 5 showing the top perspective view of beverage carriage 210.

While viewing FIG. 3 to FIG. 8, one can see that beverage lift assembly 200 has a floor 218 which is at the bottom of the interior of beverage carriage 210. An external thread 222 on the exterior of beverage carriage 210 is adapted to engage an internal thread 272 in the interior of beverage lift sleeve 250 to allow the floor 218 to move up or down relative to the top cylinder edge 276 of the beverage lift sleeve 250. Thus by rotating the beverage carriage 210 relative to the beverage lift sleeve 250 one can adjust how much of a beverage container sitting on the floor of the 218 would extend above the top cylinder edge 276 of the beverage lift sleeve 250.

An optional alignment extension 280 may be added to help an end user insert the bottom end of a beverage carriage 210 into the open top end of a beverage lift sleeve 250 in order to reduce the risk of cross-threading. The alignment extension 280 could be one or more tabs as shown here or could simply be an unthreaded upper portion of the beverage lift sleeve 250.

Figure 9:
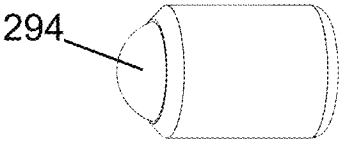
FIG. 9 shows an enlarged image of a ball detent mechanism 290.

An optional window 254 in the beverage lift sleeve 250 allows size markers 224 on the exterior of the beverage carriage 210 to be visible when the rotation of the beverage carriage 210 relative to the beverage lift sleeve 250 is optimized for a particular beverage container type such as a standard twelve-ounce can. FIG. 9 shows an enlarged image of a ball detent mechanism 290. One or more ball detent mechanisms 290 may be placed in cavities 258 of the beverage lift sleeve 250. As is well known in the art, a spring within the ball detent mechanism urges a ball 294 forward when presented with a stop cavity. A set of stop cavities 228 on the exterior of beverage carriage 210 can be placed so as to provide a stop when the rotation of the beverage carriage 210 relative to the beverage lift sleeve 250 has reached a configuration that is appropriate for a particular type of beverage container. The stop is not a hard stop. A bit of additional effort by the end user will allow the detention effect of the ball detent mechanism 290 to be overcome to resume the rotation of the beverage carriage 210 relative to the beverage lift sleeve 250.

Those of skill in the art will appreciate that the size markers could be arranged to be visible above and below the beverage lift sleeve 250. A designer may simply allow a user to vary the distance between the floor 218 and the top cylinder edge 276 of the beverage lift sleeve 250 in order to tailor the beverage insulator 100 for a given size beverage container.

Beverage lift sleeve 250 has bevel 264 and shoulder 268 to allow the insertion depth of the beverage lift assembly 200 within the beverage insulator 100 to be limited by the interior of the insulated shell 110 with upper bevel 134 and lower bevel 138 (See FIG. 2).

Shell Lid.

Figure 12:
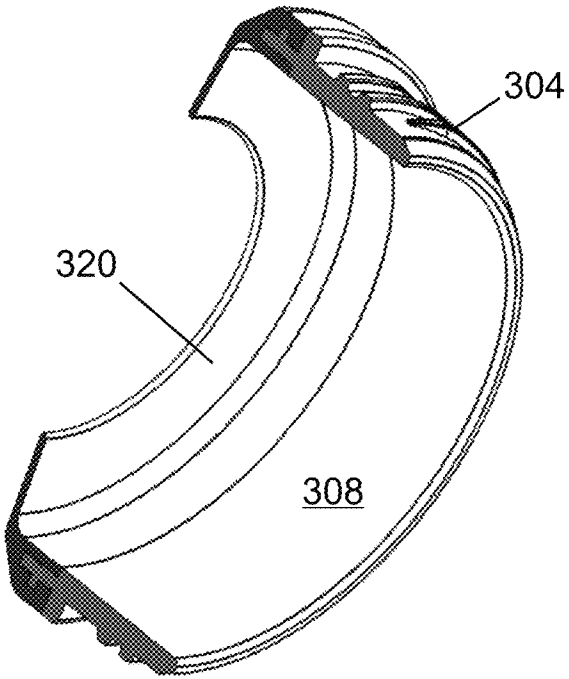
FIG. 12 is the cross section of FIG. 11 rotated to show the interior of shell lid 300.
Figure 10:
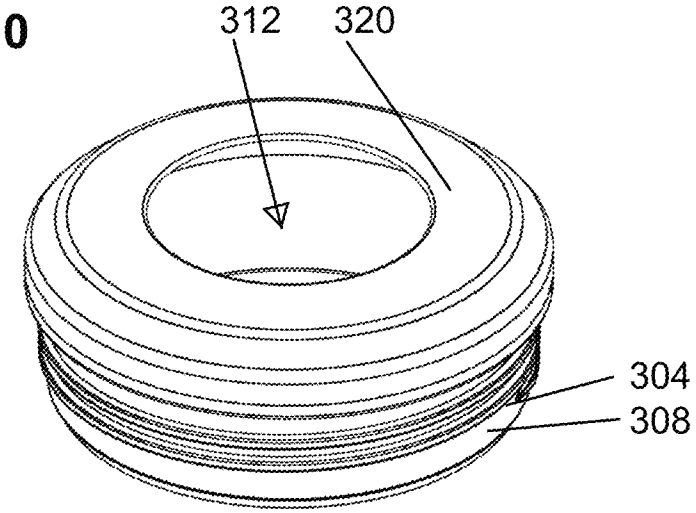
FIG. 10 is a top perspective view of shell lid 300.
Figure 11:
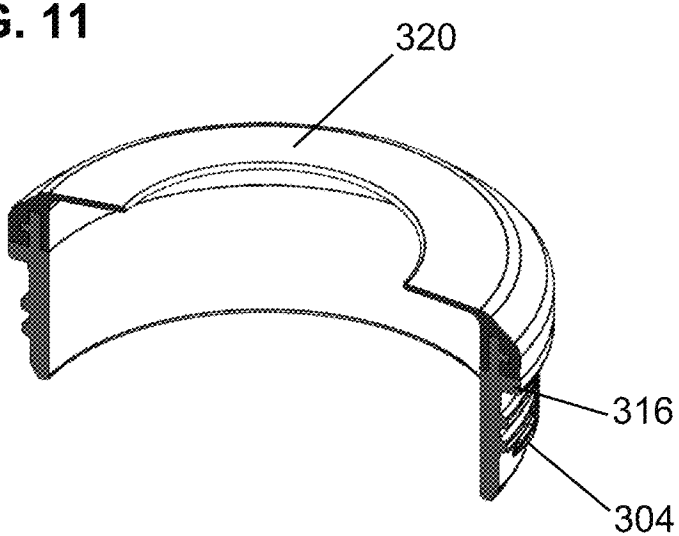
FIG. 11 is a cross section of this same view.

FIG. 10 is a top perspective view of shell lid 300. FIG. 11 is a cross section of this same view. FIG. 12 is the cross section of FIG. 11 rotated to show the interior of shell lid 300.

Shell lid 300 has external thread 304 on cylindrical wall 308, opening 312, and shoulder 316. Top portion 320 between opening 312 and the cylindrical wall 308 may optionally be made of a softer material than used for cylindrical wall 308 in order to have the top portion 320 at least partially conform to the upper portion of a beverage container inserted into the beverage insulator 100. One of skill in the art will appreciate that the differences in material characteristics may be obtained by overmolding the top portion 320 onto a relatively rigid cylindrical wall 308. One suitable material for use in the overmolded portion is silicone. One of skill in the art will appreciate that having the top portion 320 partially block ambient air from entry into the open top end 114 of the insulated shell 110 will help in the effort of insulating the beverage container from ambient air temperature. In some instances the top portion 320 may substantially but not totally take up all area between the exterior of a particularly small diameter beverage container and the perimeter of the insulated shell 110.

One of skill in the art will appreciate that having the top portion 320 positioned to partially cover a beverage container while allowing an end user to drink from the beverage container serves the purpose of holding the beverage container within the insulated shell 110 even while the end user is tilting the beverage container a significant amount beyond horizontal in order to consume the last of the fluid within the beverage container.

Bottle Opener.

Figure 13:
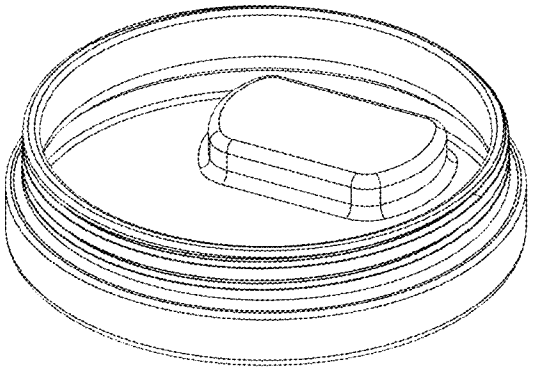
FIG. 13 is a top perspective view of optional bottle opener 400 with bottle opening cavity 404 on the bottom face 408 of the bottle opener 400.
Figure 14:
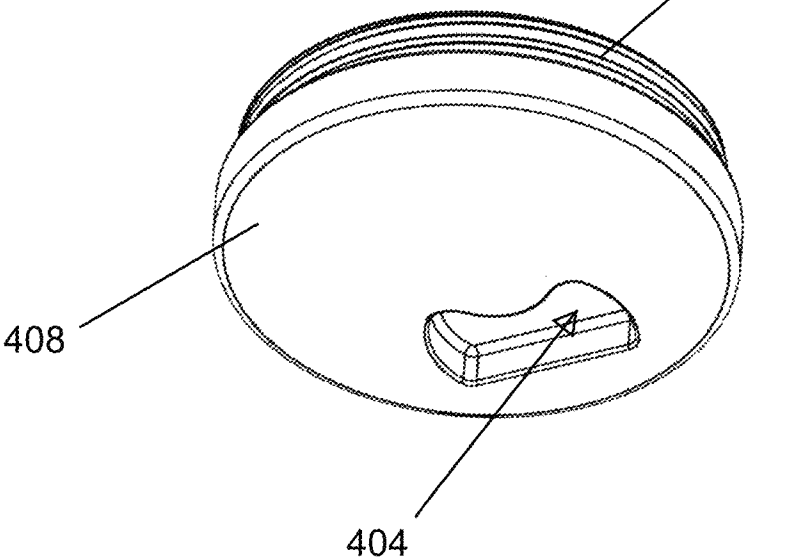
FIG. 14 is a bottom perspective view of optional bottle opener 400.

FIG. 13 is a top perspective view of optional bottle opener 400 with bottle opening cavity 404 on the bottom face 408 of the bottle opener 400. FIG. 14 is a bottom perspective view of optional bottle opener 400. The bottle opener 400 can be reversibly engaged via an external thread 412 to a corresponding interior thread 148 of the optional lower portion 140 of insulated shell 110 (See FIG. 2). One of skill in the art will appreciate that the storage cavity 416 (FIG. 16 discussed below) provides a convenient place to store small items like lip balm, keys, cash, mints, et cetera.

Cross Section of Beverage Insulator.

Figure 15:
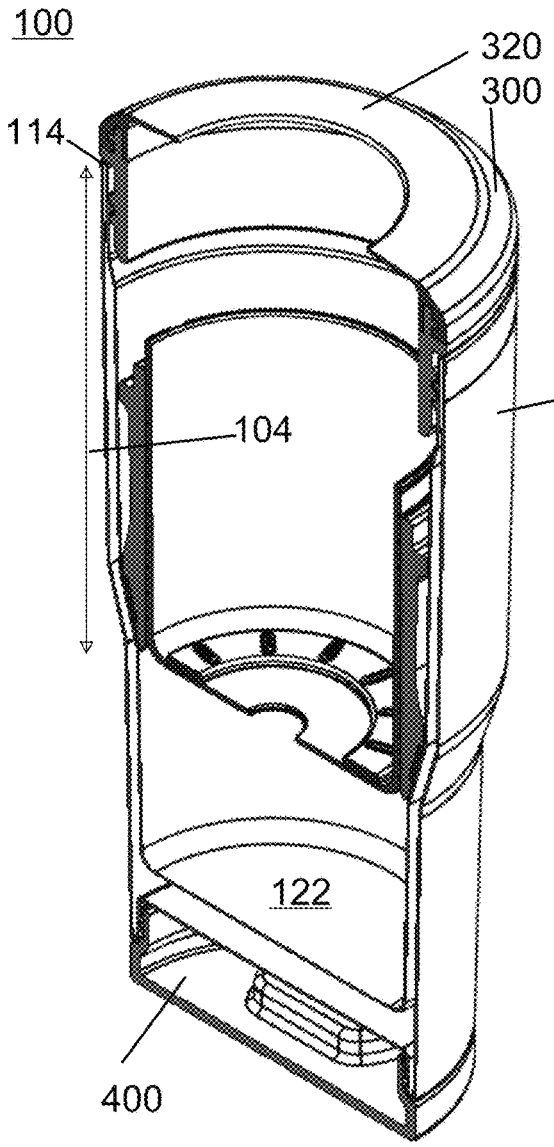
FIG. 15 is a top perspective view of beverage insulator 100 as seen in cross section.
Figure 16:
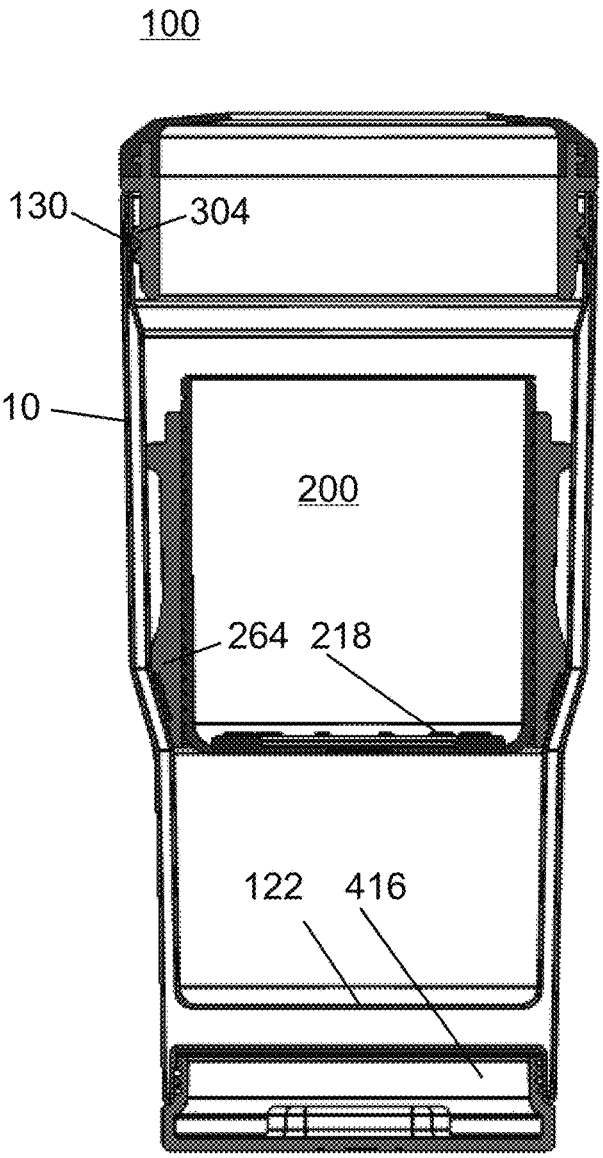
FIG. 16 is a cross section of beverage insulator 100 taken from a front view.

FIG. 15 is a top perspective view of beverage insulator 100 as seen in cross section. FIG. 16 is a cross section of beverage insulator 100 taken from a front view. In these cross sections, the threaded engagement of interior thread 130 of insulated shell 110 and external thread 304 of shell lid 300 is visible. The lower bevel 138 of insulated shell 110 limits the insertion of the beverage lift assembly 200 within the insulated shell 110 as the bevel 264 of the beverage lift sleeve 250 abuts lower bevel 138.

The distance 104 from the floor 218 of the beverage lift assembly 200 to the open top end 114 of the insulated shell 110 is shown. Note that the floor 218 of the beverage carriage 210 may include features to help seat and stabilize the bottoms of certain common beverage containers. Thus, some beverage containers may seat on top of the features on the floor 218 and not contact the lowest part of the floor 218. This distinction is not important as the designer can use the combination of the feature pattern and feature heights combined with the thread per inch choice used in the external thread 222 and internal thread 272 in order to provide an array of distances between the resting place of a beverage container on the floor 218 of the beverage carriage and the open top end of the beverage lift sleeve 250.

Rubber Pad

Figure 17:
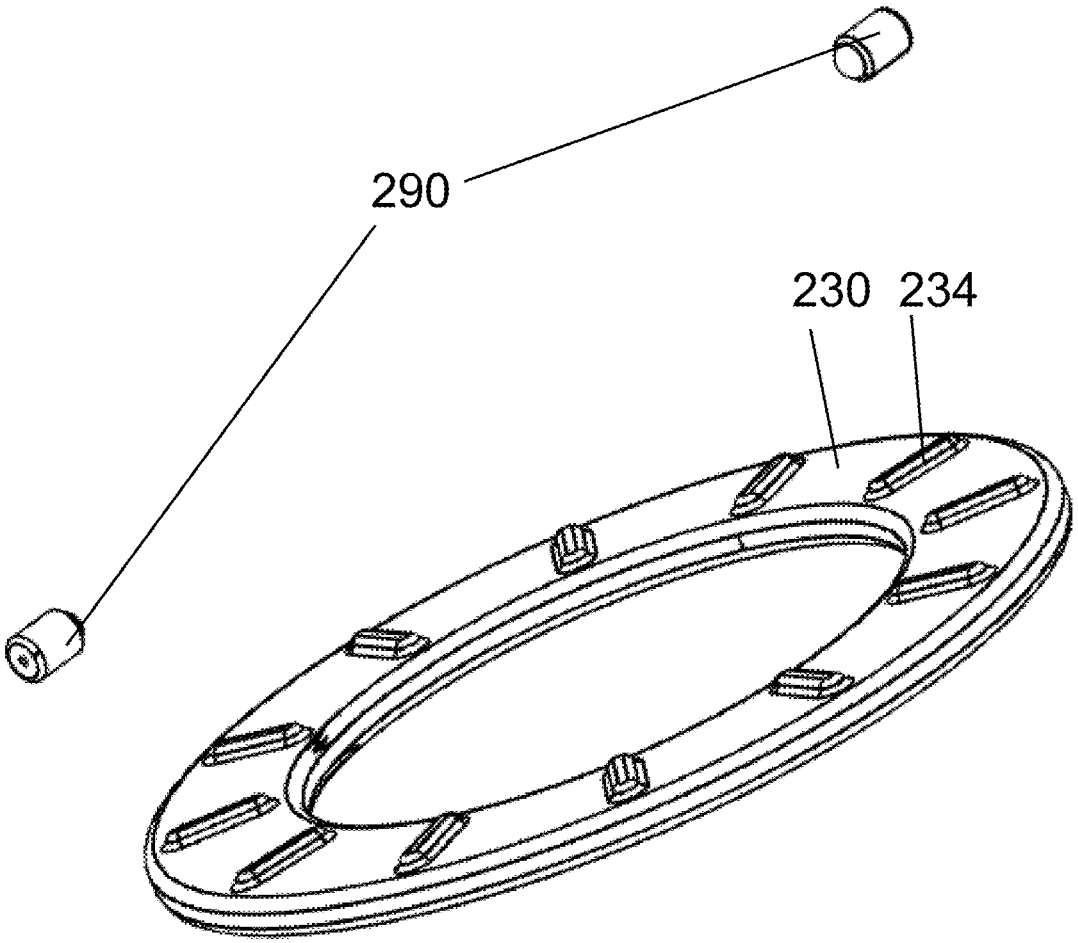
FIG. 17 shows a top perspective view of a compressible friction pad 230.

The floor of the beverage carriage 210 may have a compressible friction pad 230 with raised portions 234. FIG. 17 shows a top perspective view of a compressible friction pad 230. The use of a soft material such as rubber for the compressible friction pad 230 allows a beverage container pressing down on the compressible friction pad 230 to transfer a rotation input from an end user to fine tune the height of the beverage carrier floor 218 by rotating the beverage container and thus rotating the beverage carriage 210 relative to the beverage lift sleeve 250. Thus the end user can alter the height of the top of the beverage container without removing the beverage carriage 210 from the insulated shell 110. Those of skill in the art will appreciate that while the compressible friction pad 230 may optionally be integral to the beverage carriage 210, the compressible friction pad 230 may be added to a base beverage carriage through overmolding or some other process that would provide a substantially permanent attachment of the compressible friction pad 230 to the beverage carriage 210.

Adhering one or more rubber strips to the outside of beverage lift sleeve 250 so that the one or more rubber strips make contact with the inside of the insulated shell 110 helps keep the beverage lift sleeve 250 from spinning within the insulated shell 110. This makes it easier to rotate the beverage carrier 210 relative to the beverage lift sleeve 250 and thus change the floor height.

In order to provide a sense of scale, FIG. 17 also shows the ball detent mechanisms 290 that may be placed in cavities 258 of the beverage lift sleeve 250.

Process of Use.

Figure 18:
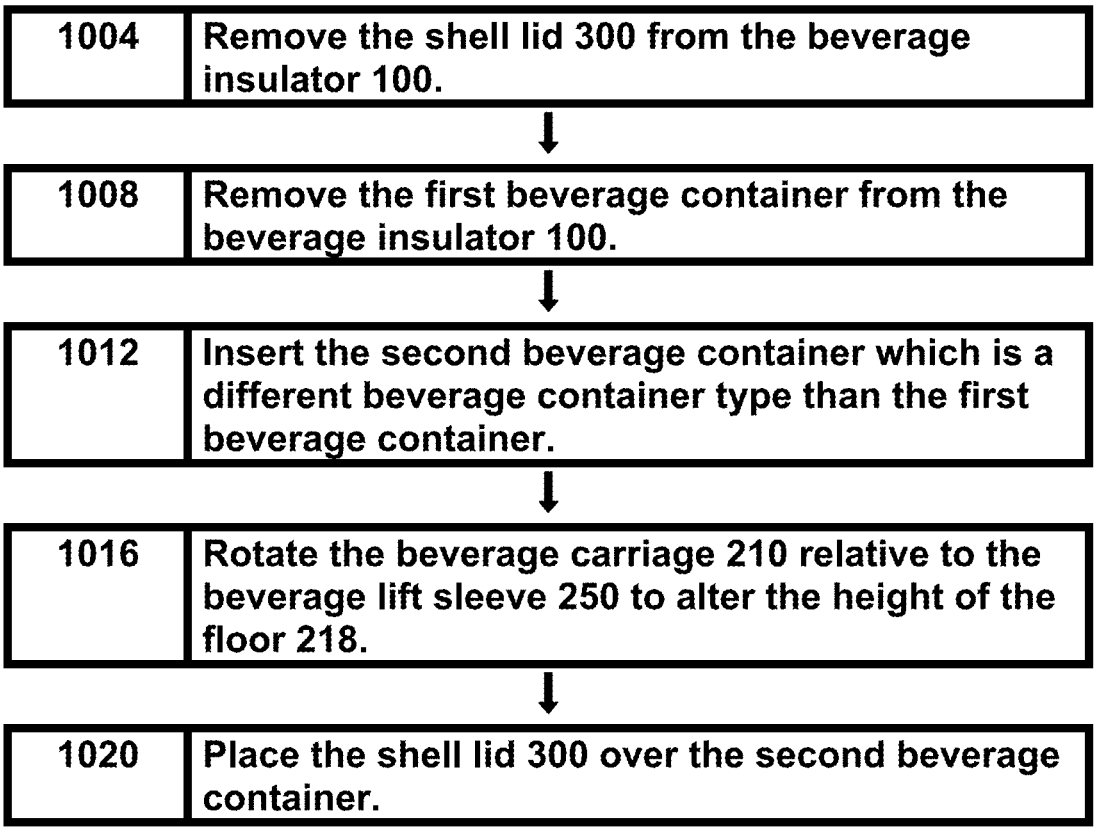
FIG. 18 sets forth a process 1000 for adjusting a beverage insulator 100.

FIG. 18 sets forth a process 1000 for adjusting a beverage insulator 100. More specifically, FIG. 18 sets for a process 1000 to alter the beverage insulator from being adapted for use with a first beverage container type having a first distance from a first bottom of the first beverage container type to a first top of the first container type to being adapted for use with a second beverage container type having a second distance from a second bottom of the second beverage container type to a second top of the second container type, wherein the first distance is different from the second distance. The process 1000 having the following steps:

1004—Remove the shell lid 300 from the beverage insulator 100.

1008—Remove the first beverage container from the beverage insulator 100.

1012—Insert the second beverage container which is a different beverage container type than the first beverage container.

1016—Press down on the second beverage container and rotate the second beverage container relative to the beverage insulator 100 to rotate the beverage carriage 210 relative to the beverage lift sleeve 250 to alter the distance of the floor 218 of the beverage lift assembly 200 relative to the top cylinder edge 276 of the beverage lift sleeve 250. Step 1016 may include overcoming a stop force that retains the orientation between the beverage carriage 210 relative to the beverage lift sleeve 250 in a position adapted for use with the first beverage container type.

1020—Place the shell lid 300 over the second top of the second beverage container of the second container type and engage the shell lid 300 with the insulated shell 110. One of skill in the art will appreciate that for certain beverage containers that are slim or sleek styles that might require the end user to align the top of the beverage container with the shell lid 300.

One of skill in the art will appreciate that the twisting of the beverage container relative to the beverage insulator 100 to rotate the beverage carriage 210 relative to the beverage lift sleeve 250 to alter the distance of the floor 218 of the beverage lift assembly 200 relative to the top cylinder edge 276 of the beverage lift sleeve 250 could be done with the first beverage container to prepare the beverage lift assembly for the second container of a different container type. But this would rely on the user knowing the sequence of container height configurations and counting the changes and it is much simpler for a new user to position the second beverage container at an appropriate height with the second beverage container in the beverage lift assembly 200.

One of skill in the art will appreciate that the twisting of the beverage container relative to the beverage insulator could raise or lower the floor 218 of the beverage lift assembly unless the floor 218 was already at an end of the range.

One of skill in the art will appreciate that alternatively, a user could simply remove the beverage lift assembly 200 from the beverage insulator 100, adjust the beverage lift assembly 200 to the new desired height and then reinsert the beverage lift assembly into the beverage insulator before inserted the second beverage container. The remove-adjust-reinsert sequence would be a preferred choice for new users that needed the guidance from the optional window 254 (FIG. 3) in the beverage lift sleeve 250 allows size markers 224 on the exterior of the beverage carriage 210 to be visible when the rotation of the beverage carriage 210 relative to the beverage lift sleeve 250 is optimized for a particular beverage container type such as a standard twelve-ounce can.

ALTERNATIVES AND VARIATIONS

More than One Thread.

The threaded engagement between the beverage carriage 210 and the beverage lift sleeve 250 could be made using two or more helical threads instead of the most common use of a single helical thread.

Insulated Wall.

While a double wall vacuum insulated container is a suitable choice for the insulated shell 110, other choices may be made for the insulated tumbler. Conventional choices include covering an interior vessel with an insulative material such as a rubber, polymer, foamed material, glass, or ceramic. The insulation may include trapped air. Material with a phase change at a relevant temperature range may be employed to allow phase change of the material to absorb heat.

Using Insulated Shell as a Tumbler.

From time to time, an end user may wish to drink fluids from the insulated shell 110 without the use of a beverage container. The end user could simply remove the shell lid 300 and any beverage container within the beverage lift assembly 200 and pour fluid into the interior of the insulated shell 110 before drinking from the insulated tumbler. Alternatively, the end user could remove the shell lid 300, any beverage container in the beverage lift assembly 200, and the beverage lift assembly 200 from the insulated shell 110 before pouring fluid into the interior of the insulated shell 110.

Figure 19:
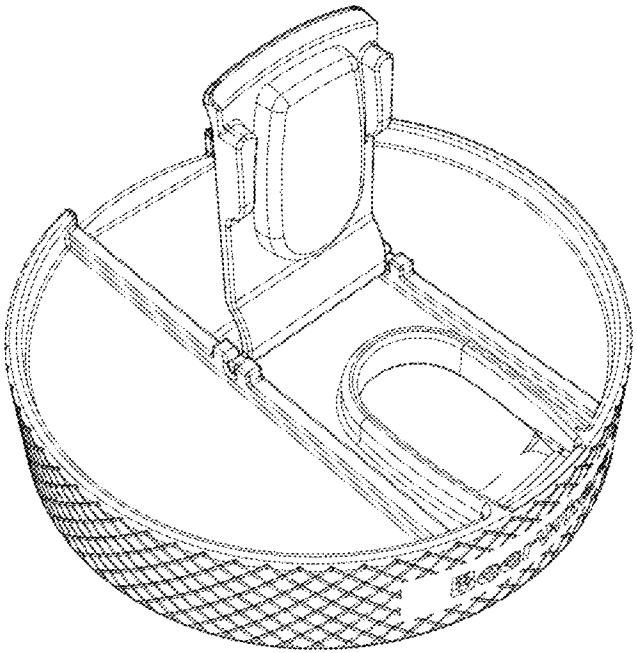
FIG. 19 shows a travel lid 190.

As the end user may use the insulated shell 110 to drink fluids from the interior of the insulated shell 110, a kit for sale to an end user may include a travel lid 190 (FIG. 19) that engages with the open end of the insulated shell 110 to seal the insulated shell 110. The engagement can be by any conventional mechanism including press fit, threaded fit, bayonet fit or other form of attachment.

Threaded Travel.

This disclosure shows a beverage lift assembly 200 that allows a variation in the position of the floor 118 relative to the top of the beverage lift assembly that can vary by seven and a half inches. This specific range of travel is not a requirement of the present disclosure.

Inversion of the Beverage Lift Assembly.

Figure 20:
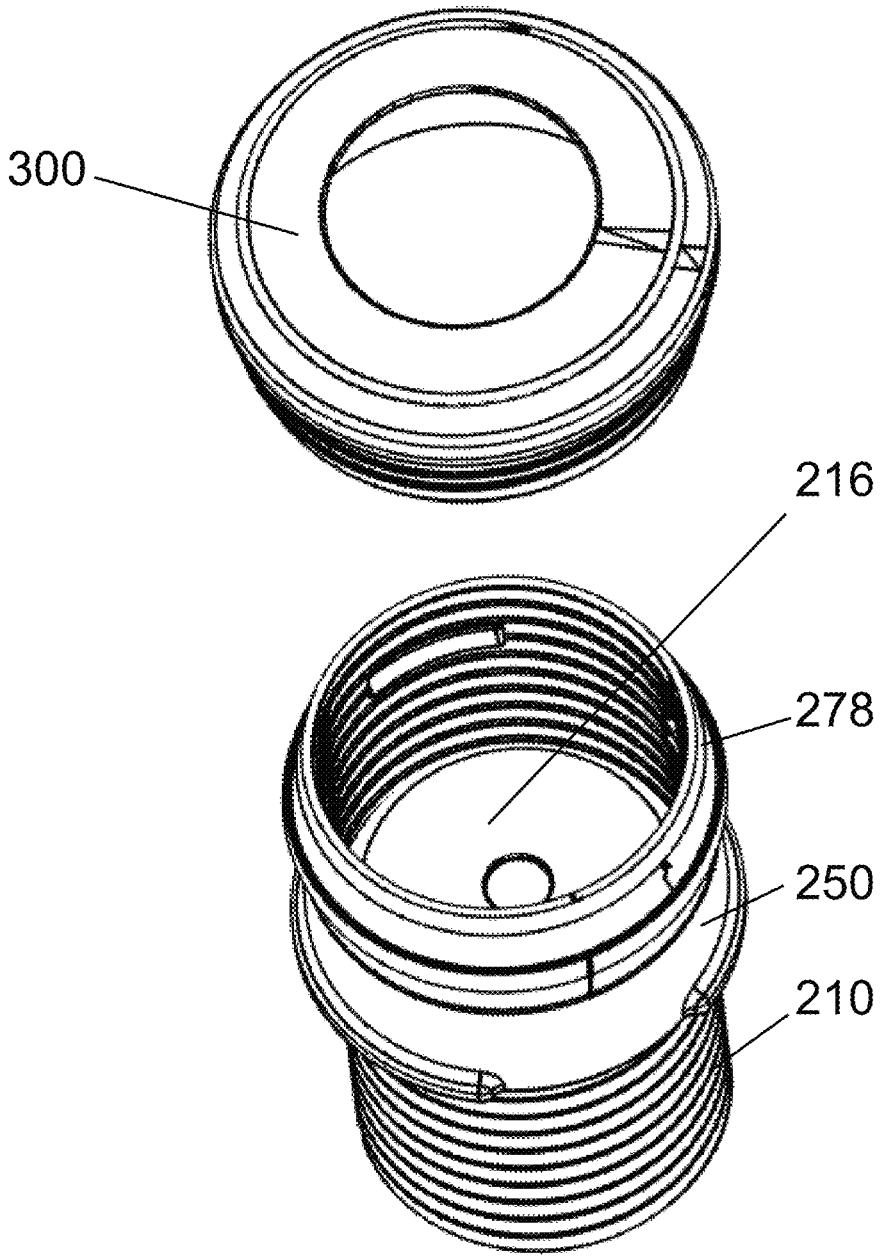
FIG. 20 shows an inverted beverage lift assembly 200 and a shell lid 300 with other components of the beverage insulator 100 hidden to minimize clutter.

The beverage lift assembly 200 and insulated shell 110 may be designed to allow the beverage lift assembly 200 to be removed from the insulated shell 110 and inverted so that the inverted floor 216 of the beverage carriage 210 of the beverage lift assembly 200 can be pushed above the inverted top edge 278 of the sleeve 250. FIG. 20 shows an inverted beverage lift assembly 200 and a shell lid 300 with other components of the beverage insulator 100 hidden to minimize clutter.

Those of skill in the art will appreciate that a system that allows the effective floor of the beverage lift assembly 200 to descend below the beverage lift sleeve 250 when the beverage lift assembly 200 is in a first orientation and to allow the effective floor of the beverage lift assembly 200 to rise above the beverage lift sleeve 250 when the beverage lift assembly is inverted relative to the first orientation allows the range in heights of the effective floor of the beverage lift assembly 200 to have a greatly enhanced range compared with the range of effective floor heights of a beverage lift assembly 200 that is not capable of inversion within the insulated shell 110.

An experienced user may choose to use a beverage container to twist the beverage carriage 210 out of the top of the beverage lift sleeve 250 so that the user can remove just the beverage carriage 210 from the insulated shell 110. Once removed, the beverage carriage 210 may be inverted and then reinserted into the beverage lift sleeve 250 before twisting to reach the proper height.

Figure 21:
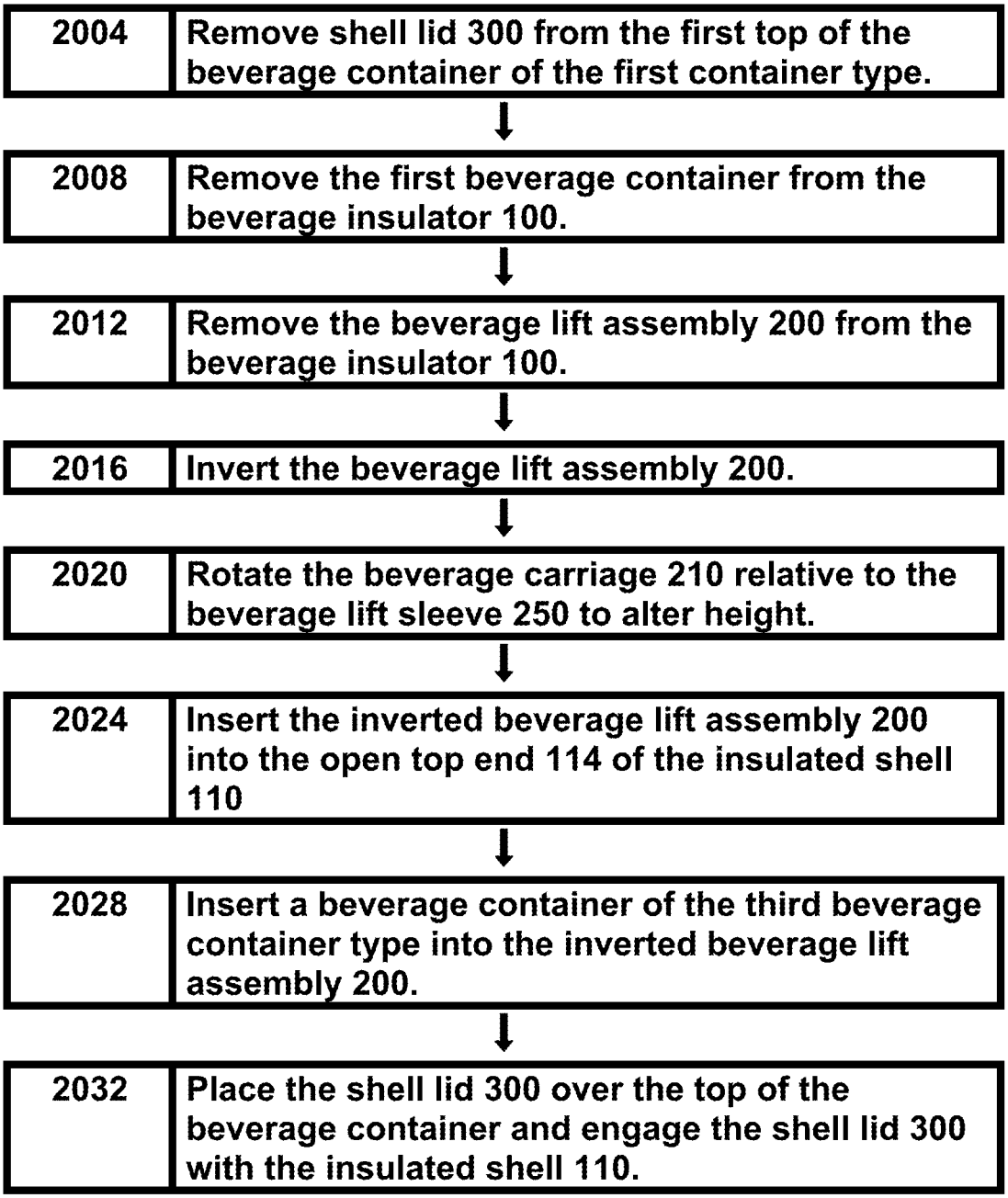
FIG. 21 sets forth a process 2000 for adjusting a beverage insulator 100 though inversion of the beverage lift assembly 200.

FIG. 21 sets forth a process 2000 for adjusting a beverage insulator 100 though inversion of the beverage lift assembly 200. More specifically, FIG. 21 sets forth a second process 2000 for adjusting a beverage insulator 100 to alter the beverage insulator from being adapted for use with a first beverage container type having a first distance from a first bottom of the first beverage container type to a first top of the first container type to being adapted for use with a third beverage container type having a third distance from a third bottom of the third beverage container type to a third top of the third container type, wherein the first distance is different from the third distance. The process 2000 having the following steps:

2004—Remove shell lid 300 from the first top of the beverage container of the first container type.

2008—Remove the first beverage container from the beverage insulator 100.

2012—Remove the beverage lift assembly 200 from the beverage insulator 100.

2016—Invert the beverage lift assembly 200.

2020—Rotate the beverage carriage 210 relative to the beverage lift sleeve 250 to alter the distance of the inverted floor 216 (FIG. 20) of the beverage lift assembly 200 relative to the inverted top edge 278 (FIG. 20) of the beverage lift sleeve 250.

2024—After altering the distance of the inverted floor 216 of the beverage lift assembly 200 relative to the inverted top edge 278 of the beverage lift sleeve 250 sufficient for use with the third beverage container, insert the inverted beverage lift assembly 200 into the open top end 114 of the insulated shell 110 until an interaction between the exterior of the beverage lift assembly 200 and the interior of the insulated shell 110 precludes further insertion.

2028—Insert the third bottom of a third beverage container of the third beverage container type into the inverted beverage lift assembly 200. One of skill in the art will appreciate that the beverage container of the third beverage container type could be inserted into the inverted beverage lift assembly 200 before the inverted beverage lift assembly 200 is inserted into the open end of the insulated shell 110 but many users may prefer to insert the inverted beverage lift assembly 200 into the insulated shell 110 before inserting the third beverage container of the third beverage container type into the inverted beverage lift assembly 200. The process does not mandate either sequence.

2032—Place the shell lid 300 over the third top of the beverage container of the third container type and engage the shell lid 300 with the insulated shell 110. One of skill in the art will appreciate that for certain beverage containers that are slim or sleek styles that might require the end user to align the top of the beverage container with the shell lid 300.

Engagement of Shell Lid to Insulated Shell.

While those of skill in the art will appreciate that a threaded connection between the shell lid 300 and the insulated shell 110 is a conventional choice—it is not the only viable choice. The teachings of the present disclosure with respect to the beverage lift assembly 200 could be employed with a shell lid that engages through a press fit, a bayonet fitting, or any other reversible connector.

As the shell lid 300 and the insulated shell 110 are apt to get we during use and the intended use of the beverage insulator 100 is to retain a beverage container which may be a glass container while the beverage insulator is substantially inverted, one of skill in art will appreciate that a mere interference fit (sometimes called a press fit or friction fit) may not be the best way to engage the shell lid 300 to the insulated shell 110. Thus, most designers will seek some sort of positive engagement between a portion of the shell lid 300 and a portion of the insulated shell 110 rather than a mere interference fit. There are many such option available to those of skill in the art.

Figure 22:
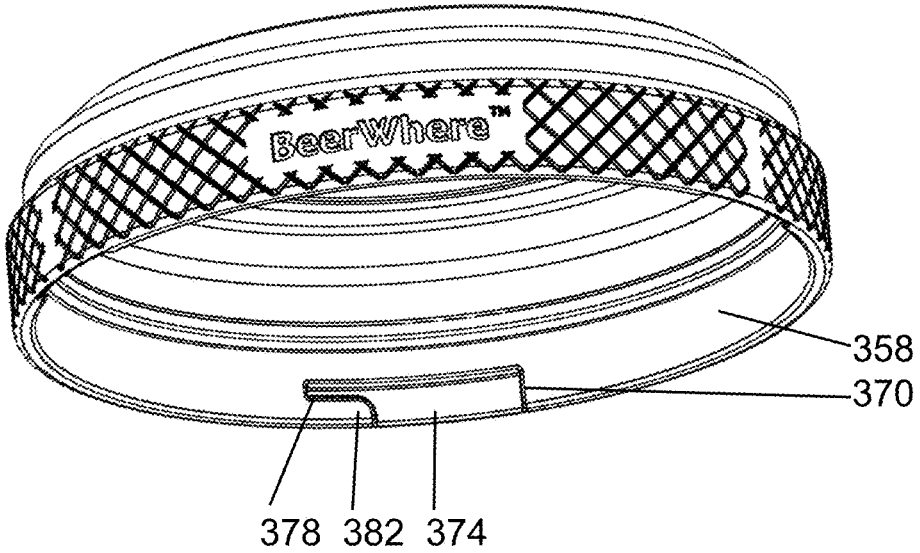
FIG. 22 is a bottom side perspective view of alternative shell lid 350.
Figure 23:
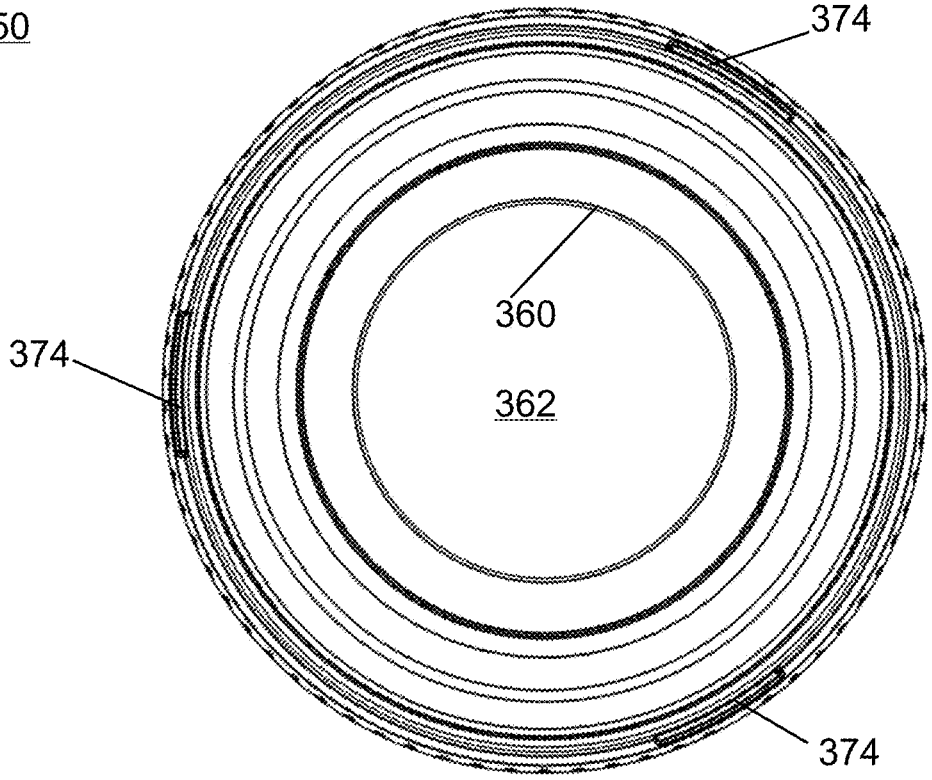
FIG. 23 is a bottom plan view of alternative shell lid 350

FIG. 22 and FIG. 23 show two views of alternative shell lid 350. FIG. 22 is a bottom side perspective view of alternative shell lid 350. In this view, the cylindrical wall 358 which goes outside of the corresponding insulated shell (discussed below) has a set of at least one retention feature 370. In this instance, the retention feature has a tab channel 374 and a tab slot 378 above a retention node 382. Pushing down on the alternative shell lid 350 allows the protruding tabs to enter the tab channel 374. Subsequently twisting the alternative shell lid 350 captures at least a portion of the protruding tab in the tab slot 378 so that the alternative shell lid 350 is reversibly engaged with a corresponding insulated shell.

FIG. 23 is a bottom plan view of alternative shell lid 350. In this view, the opening 362 in the top portion 360 is visible. Also visible are three tab channels 374 in the cylindrical wall 358.

Figure 24:
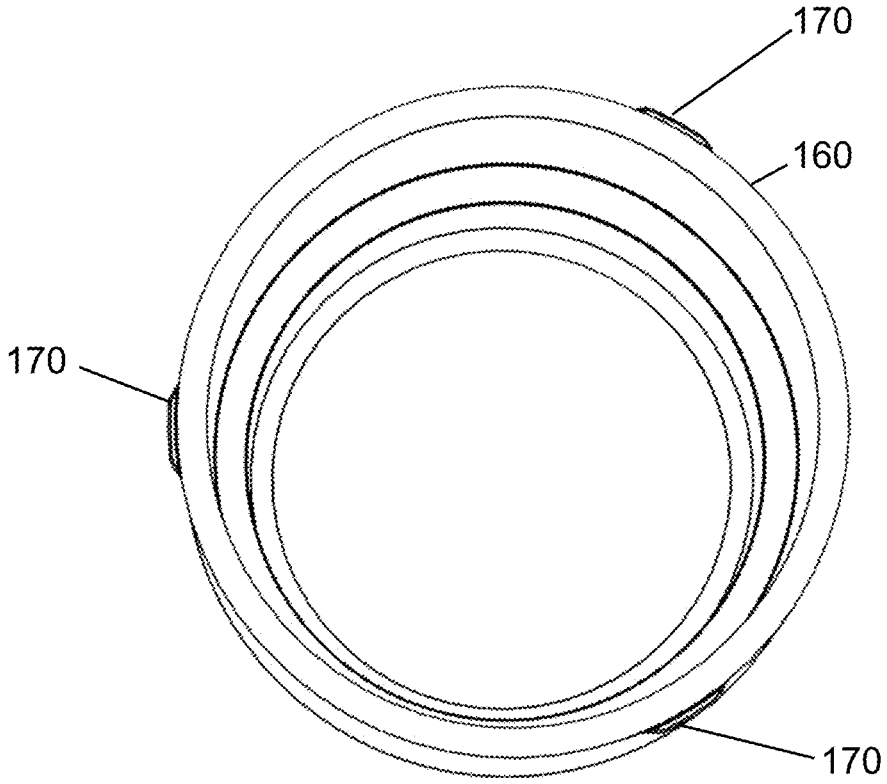
FIG. 24 is a top perspective view of alternative insulated shell 160.
Figure 25:
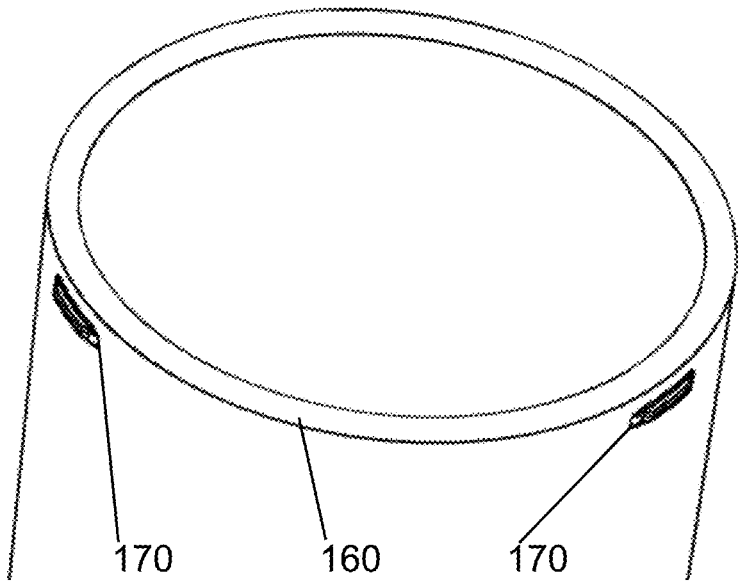
FIG. 25 is another top perspective view of the alternative insulated shell 160.

FIG. 24 is a top perspective view of alternative insulated shell 160. FIG. 25 is another top perspective view of the alternative insulated shell 160. In both figures, the some or all of the protruding tabs 170 are visible. These tabs engage with the retention features 370 in the alternative shell lid 350.

This particular example has three protruding tabs 170 and three retention features 370. One of skill in the art will appreciate that the number of protruding tabs 370 could be as low as one and could be more than three. The spacing of retention features 370 will need to accommodate the set of protruding tabs 170. A designer could have more retention features 370 than protruding tabs 170 such as having retention features spaced every 60 degrees on a variation of alternative shell lid 350.

Temperature of Beverage.

While in many instances the temperature of the fluid in the beverage container will be below forty degrees Fahrenheit and thus cooler than ambient air temperature, this is not a requirement to receive benefits from the teachings of the present disclosure. The beverage may be at a temperature above ambient temperature. The beverage may be close to ambient temperature and benefit from placement within the beverage insulator in ways beyond insulation. Examples include placing a glass container holding red wine into the beverage insulator before taking the beverage insulator to proximity to a pool or other area where unprotected glass containers are not allowed. Sometimes the ability to consume a beverage, particularly an alcoholic beverage, while not exposing the specific contents of the beverage is desired by an end user.

Relative Motion.

The adjustment of the floor of the beverage lift assembly 200 is made by relative motion of the beverage carriage 210 compared to the beverage lift sleeve 250. It does not matter whether the beverage carriage 210 is fixed relative to an external reference point, the beverage lift sleeve 250 is fixed relative to an external reference point, or that neither is fixed relative to an external reference point. All that matters is that the threaded engagement alters the height of the floor relative to a reference point on the beverage lift sleeve 250.

Phase Change Cooling.

One of skill in the art will appreciate that one could place ice in the insulated shell 110 so that the insulated shell 110 contains ice below the beverage lift assembly 200 to enhance the ability of the beverage insulator 100 to keep an inserted beverage container below ambient air temperature.

One of skill in the art will appreciate that one could place a chemical ice pack in the insulated shell 110 so that the insulated shell 110 contains the frozen chemical ice pack below the beverage lift assembly 200 to enhance the ability of the beverage insulator 100 to keep an inserted beverage container below ambient air temperature.

Adjustability.

It is easy to get caught up in the details and lose the elegance of an innovative design. So this disclosure closes with FIG. 26 which shows cross sections of three beverage insulators with non-inverted beverage lift assemblies 200 that are each insulating a beverage container.

Figure 26:
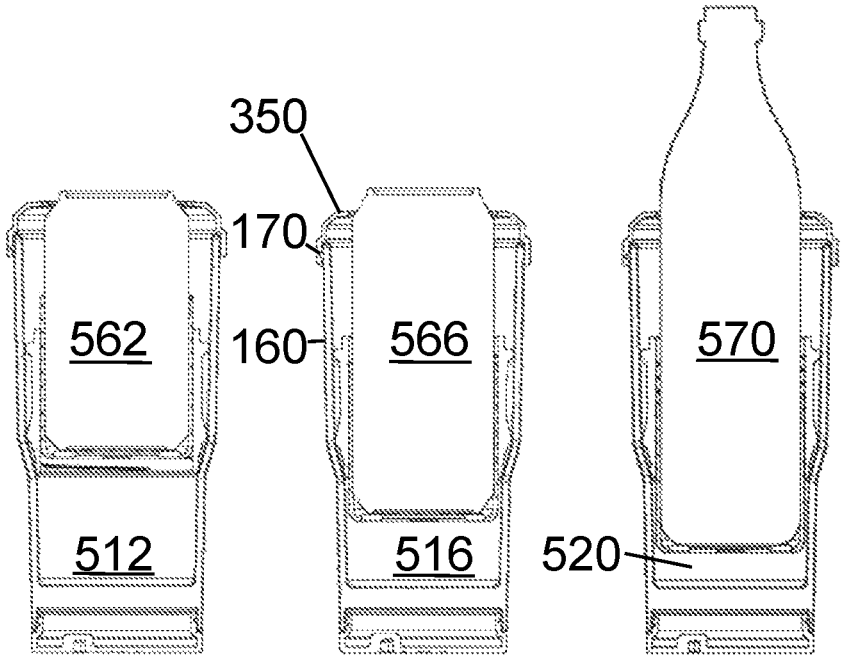
FIG. 26 which shows cross sections of three beverage insulators with non-inverted beverage lift assemblies 200 that are each insulating a beverage container

A careful observer will note that the beverage insulators are using insulated shells 160 with protruding tabs 170 that are reversibly engaged with the alternative shell lids 350. FIG. 26 has a first beverage insulator 512 that is holding a 12 ounce can 562, a second beverage insulator 516 holding a 16 ounce can 566, and a third beverage insulator 520 holding a 16.9-ounce bottle 570.

One of skill in the art will recognize that some of the alternative implementations set forth above are not universally mutually exclusive and that in some cases additional implementations can be created that employ aspects of two or more of the variations described above. Likewise, the present disclosure is not limited to the specific examples or particular embodiments provided to promote understanding of the various teachings of the present disclosure. Moreover, the scope of the claims which follow covers the range of variations, modifications, and substitutes for the components described herein as would be known to those of skill in the art.

Where methods and/or events described above indicate certain events and/or procedures occurring in a certain order, the ordering of certain events and/or procedures may be modified. Additionally, certain events and/or procedures may be performed concurrently in a parallel process, when possible, as well as performed sequentially as described above.

The legal limitations of the scope of the claimed invention are set forth in the claims that follow and extend to cover their legal equivalents. Those unfamiliar with the legal tests for equivalency should consult a person registered to practice before the patent authority which granted this patent such as the United States Patent and Trademark Office or its counterpart.

What is claimed is:

1. A beverage insulator adapted to allow an end user to consume liquids from a first beverage container having a first height measured from a bottom of the first beverage container to a top end of the first beverage container which has an opening to allow fluid to be poured from the first beverage container; and adapted to allow the end user to consume liquids from a second beverage container having a second height measured from a bottom of the second beverage container to a top end of the second beverage container which has an opening to allow fluid to be poured from the second beverage container wherein the first height is not equal to the second height;

the beverage insulator comprising:

an insulated shell 110 with an open top end and a closed bottom end so that fluid can be introduced through the top end and held within the insulated shell;

a beverage lift assembly 200 that fits within the insulated shell and may be adjusted to move a floor of the beverage lift assembly relative to the open top end of the insulated shell to adjust distance from the floor of the beverage lift assembly to the open top end of the insulated shell;

the beverage lift assembly 200 comprising:

a beverage carriage 210 with an open top end; the beverage lift assembly floor; and a cylindrical beverage carriage wall with an external thread;

a beverage lift sleeve 250 with an open top end and an open bottom end separated by a fixed distance;

the beverage lift sleeve having an internal thread that allows the cylindrical beverage carriage wall to rotate within an interior of the beverage lift sleeve to alter a distance between beverage lift assembly floor and the open top end of the beverage lift sleeve; and the beverage lift sleeve sized to fit within a top portion of the insulated shell so that a maximum insertion depth of the beverage lift sleeve within the insulated shell is limited and the beverage lift sleeve does not rest on the closed bottom end of the insulated shell but is suspended; and suspension of the beverage lift sleeve allows for the beverage carriage to extend beyond the open bottom of the beverage lift sleeve towards the closed bottom of the insulated shell wherein a range of heights for the floor of the beverage lift assembly relative to the open top end of the insulated shell is greater than the fixed distance between the open top end of the beverage lift sleeve and the open bottom end of the beverage lift sleeve.

2. The beverage insulator of claim 1 further comprising a tumbler lid, the tumbler lid having:

a tumbler lid top with an opening, a cylindrical wall that extends downward from the tumbler lid top, the cylindrical wall having an external thread that engages with a corresponding internal thread located within an interior of the insulated shell so that rotation of the tumbler lid top relative to the insulated shell causes engagement of the external thread and the internal thread to move the tumbler lid towards the closed bottom end of the insulated shell.

3. The beverage insulator of claim 2 wherein at least a portion of the tumbler lid between the opening of the tumbler lid and the cylindrical wall is created from a material adapted to allow the tumbler lid to partially conform to an upper portion of a beverage conatiner trapped between the tumbler lid and the floor of the beverage carriage.

4. The beverage insulator of claim 1 further comprising a window in the beverage lift sleeve to expose markings on the beverage carriage to help an end user alter the distance between the floor of the beverage carriage and the open top end of the beverage lift sleeve an appropriate amount for a particular type of beverage container.

5. The beverage insulator of claim 4 wherein the beverage lift assembly has a set of at least one ball detent mechanism to provide tactile indications to help the end user alter the distance between the floor of the beverage carriage and the open top end of the beverage lift sleeve an appropriate amount for a particular type of beverage container.

6. The beverage insulator of claim 1 wherein the insulated shell has at least one handle extending radially outward from an exterior of the insulated shell.

7. The beverage insulator of claim 1 wherein the insulated shell is a vacuum insulated, double wall tumbler.

8. The beverage insulator of claim 1 wherein the interior of the beverage insulator is made from stainless steel.

9. The beverage insulator of claim 1 wherein the beverage insulator includes a travel lid for use when fluids are introduced into the interior of the beverage insulator when the beverage lift assembly is not within the the beverage insulator.

10. The beverage insulator of claim 1 wherein the beverage insulator includes an integrated bottle opener.

11. A process for adjusting a beverage lift assembly for use within an insulated shell from a first mode tuned for use with a first beverage container shape having a first height to a second mode tuned for use with a second beverage container shape having a second height which is different from the first height, the process comprising:

obtaining the beverage insulator of claim 1 having the insulated shell and the beverage lift assembly wherein the beverage lift assembly comprises a beverage carriage threadedly engaged with a beverage lift sleeve; and rotating the beverage carriage relative to the beverage lift sleeve to alter a distance from a beverage lift floor to a top of the beverage lift sleeve in order to compensate for a difference between the first height of the first beverage container shape and the second height of the second beverage container shape so that the beverage lift assembly is now tuned for the second beverage container shape.

12. The process for adjusting a beverage lift assembly of claim 11 wherein rotating the beverage carriage relative to the beverage lift sleeve occurs while the beverage lift assembly is within the insulated shell.

13. The process for adjusting a beverage lift assembly of claim 11 wherein rotating the beverage carriage relative to the beverage lift sleeve occurs while the beverage lift assembly is outside of the insulated shell.

14. The process of adjusting a beverage lift assembly of claim 13 wherein a user sees an indication that the beverage lift assembly is now tuned for the second beverage container shape through a window in the beverage lift sleeve.

15. The process of claim 11 further comprising:

inserting a beverage container of the second beverage container shape into the beverage insulator so that a bottom of the beverage container rests upon the beverage lift floor within the beverage lift so that a top of the beverage container extends above an open top end of the insulated shell; and placing a shell lid over the top of the beverage container and engaging the shell lid with the open top end of the insulated shell to reduce an opportunity for ambient air to contact a portion of the beverage container that is within the insulated shell.

16. The process of claim 15 wherein the shell lid engages with the open top end of the insulated shell via a reversible connection other than an interference fit.

17. A process for adjusting the beverage insulator of claim 1 from a first mode tuned for use with a first beverage container shape having a first height to a second mode tuned for use with a second beverage container shape having a second height which is different from the first height, the process comprising:

obtaining the beverage insulator of claim 1 in the first mode tuned for use with a first beverage container shape having a first height;

removing a beverage lift from an interior of an insulated shell having an open top end and a closed bottom end;

the beverage lift in a first orientation such that an inserted beverage container rests on a first side of a beverage lift floor;

inverting the beverage lift 180 degrees so that a subsequent interaction with a subsequent beverage container rests on a second side of the beverage lift floor, different from the first side of the beverage lift floor;

rotating a beverage carriage relative to a beverage lift sleeve to alter a distance from the second side of the beverage lift floor to a top of the inverted beverage lift sleeve in order to compensate for a difference between the first height of the first beverage container shape and the second height of the second beverage container shape so that the beverage lift is now tuned for the second beverage container shape; and inserting the inverted beverage lift that is tuned for the second beverage container shape into the interior of the insulated shell.

18. The process of claim 17 further comprising inserting a beverage container of the second beverage container shape into the beverage insulator so that a bottom of the beverage container rests upon the beverage lift floor within the beverage lift so that a top of the beverage container extends above the open top end of the insulated shell.

19. The process of claim 18 further comprising placing a shell lid over the top of the beverage container and engaging the shell lid with the open top end of the insulated shell to reduce an opportunity for ambient air to contact a portion of the beverage container that is within the insulated shell.

20. The process of claim 19 wherein the shell lid engages with the open top end of the insulated shell via a threaded connection.

* * * * *